US007832444B2

(12) United States Patent
Allen et al.

(10) Patent No.: US 7,832,444 B2
(45) Date of Patent: Nov. 16, 2010

(54) ENVELOPE FLAP CLOSING SYSTEM

(75) Inventors: Robert J. Allen, Shelton, CT (US); Thomas M. Lyga, Southbury, CT (US); Neil F. Baldino, Sandy Hook, CT (US)

(73) Assignee: Pitney Bowes Inc., Stamford, CT (US)

( * ) Notice: Subject to any disclaimer, the term of this patent is extended or adjusted under 35 U.S.C. 154(b) by 1182 days.

(21) Appl. No.: 11/471,161

(22) Filed: Jun. 20, 2006

(65) Prior Publication Data

US 2007/0289702 A1 Dec. 20, 2007

(51) Int. Cl.
*B43M 5/04* (2006.01)

(52) U.S. Cl. ..... 156/442.1; 156/442.3; 156/475; 156/486

(58) Field of Classification Search ..... 156/442.2, 156/442.3
See application file for complete search history.

(56) References Cited

U.S. PATENT DOCUMENTS

| | | | | |
|---|---|---|---|---|
| 4,071,997 | A * | 2/1978 | Gunther et al. | 53/429 |
| 4,450,037 | A | 5/1984 | Gavronsky | 156/441.5 |
| 5,674,348 | A | 10/1997 | DeFiguerido | 156/441.5 |
| 5,702,098 | A | 12/1997 | Gottlieb et al. | 270/58.06 |
| 5,956,930 | A * | 9/1999 | Baker et al. | 53/460 |
| 6,041,569 | A | 3/2000 | Freeman et al. | |
| 6,346,149 | B1 | 2/2002 | Gregoire et al. | |
| 6,640,521 | B2 | 11/2003 | Simkins et al. | 53/460 |
| 6,913,054 | B2 | 7/2005 | Miller et al. | 156/357 |
| 6,948,540 | B2 | 9/2005 | Brignell et al. | 156/360 |
| 2006/0185788 | A1 * | 8/2006 | Feijen | 156/227 |

FOREIGN PATENT DOCUMENTS

| | | | |
|---|---|---|---|
| EP | 0825037 | A1 | 2/1998 |
| EP | 16742920 | A2 | 6/2006 |

* cited by examiner

*Primary Examiner*—Richard Crispino
*Assistant Examiner*—Barbara J. Musser
(74) *Attorney, Agent, or Firm*—Angelo N. Chaclas; Steven J. Shapiro

(57) ABSTRACT

A method and system for closing opened envelopes flaps against the envelope body includes transporting an envelope in a first direction and parking the envelope in a first parked position. An envelope flap closing mechanism is moved to commence the movement of the envelope flap toward said envelope body. The envelope flap is closed against the envelope body while transporting the envelope in a second direction toward a second parked position. The flap closing mechanism may be moveable from a lower position to an upper position. The envelope flap closing system may include a first transport path of travel for envelopes to be moved seriatim in a first direction from an entrance point to an exit point. A moveable flap closing mechanism is mounted along the path of travel for movement between a lower position and an upper position. The flap closing mechanism has an upper guide surface and a lower guide surface The flap closing mechanism upper guide surface provides a guide surface as part of the first path of travel for envelopes being transported in the first direction when said flap closing mechanism is in said lower position. The flap closing mechanism lower guide surface provides a guide surface as part of a second path of travel for envelopes being transported in a second direction when the flap closing mechanism is in the upper position.

3 Claims, 8 Drawing Sheets

ENVELOPE FLAP CLOSING SYSTEM

FIELD OF THE INVENTION

The present invention relates generally to envelope flap closing systems and more particularly to a method and apparatus in which envelope flaps, including flaps larger and/or stiffer envelopes, may be closed and sealed.

BACKGROUND OF THE INVENTION

Envelope flap closing systems have been developed for use with paper handling equipment such as mailing machines and inserter systems. Envelopes vary in size and shape as do the envelope flaps. Accordingly, paper handling equipment that include envelope closing and sealing systems have frequently been limited in the sizes and types of envelopes that can be closed and sealed.

When equipment is designed to efficiently process, close and seal letter size envelopes, the equipment may be unsuitable for closing and sealing larger type envelopes, such as flat type envelopes. The paper handling equipment envelope transport paths may not be able to accommodate large envelopes, for example, due to curved transport paths. Moreover stiff envelopes of any size may not be able to be processed for closing and sealing where the transport path contains curvature with a radius of curvature too small for bending of the envelope body and/or envelope flap.

To accommodate various size envelopes, paper handling equipment may include separate transport paths for envelopes of different sizes. For example, the Pitney Bowes inserter system, Model No. DI 900 incorporates a transport path for letter size envelopes with a separate machine exit for the letter size envelopes and a second transport path for larger envelopes with a separate machine exit for the larger envelopes. An arrangement with this type of separate transport paths is described in pending U.S. patent application Ser. No. 11/084396, filed Mar. 18, 2005, for Lyga ET AL and entitled PAPER HANDLING SYSTEM MATERIALS EXIT PATH ARRANGEMENT and assigned to Pitney Bowes Inc., the disclosure of which is hereby incorporated by reference. This type system allows paper handling equipment such as an inserter system to exit standard envelopes out through the normal letter size envelope exit path and, by having an alternate exit path which is straight, the system can conveniently discharge thick or unbendable envelopes through another envelope path.

SUMMARY OF THE INVENTION

It is an object of the present invention to provide an envelope closing system suitable for larger and/or stiffer type envelopes;

It is an another object of the present invention to provide a module that can be added to paper handling equipment to extend the variety of envelopes that can be closed and sealed by the equipment.

A method for closing opened envelopes flaps against the envelope body embodying the present invention includes transporting an envelope in a first direction and parking the envelope in a first parked position. An envelope flap closing mechanism is moved to commence the movement of the envelope flap toward said envelope body. The envelope flap is closed against the envelope body while transporting the envelope in a second direction toward a second parked position.

A method for closing opened envelopes flaps against the envelope body also embodying the present invention includes moving a flap closing mechanism moveable between a lower position and an upper position into the lower position. An envelope is transported in a first direction along a first transport path and the envelope is parked in a first parked position. The envelope flap closing mechanism is moved from the lower position to the upper position to commence the movement of said envelope flap toward said envelope body. The envelope flap is closed against the envelope body while transporting the envelope in a second direction along a second transport path toward a second parking position.

An envelope flap closing system embodying the present invention includes a first transport path of travel for envelopes to be moved seriatim in a first direction from an entrance point to an exit point. A moveable flap closing mechanism is mounted along the path of travel for movement between a lower position and an upper position. The flap closing mechanism has an upper guide surface and a lower guide surface. The flap closing mechanism upper guide surface provides a guide surface as part of the first path of travel for envelopes being transported in the first direction when said flap closing mechanism is in said lower position. The flap closing mechanism lower guide surface provides a guide surface as part of a second path of travel for envelopes being transported in a second direction when the flap closing mechanism is in the upper position.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention. As shown throughout the drawings, like reference numerals designate like or corresponding parts.

FIGS. 1-5 are diagrammatic views of an envelope closing system embodying the present invention showing the sequence of events in closing an envelope with:

FIG. 1 illustrating the envelope moving toward a first park position and the flap closing mechanism in the down position;

FIGS. 2 illustrating the envelope in the first parked position and the flap closing mechanism in the up position;

FIGS. 3 illustrating the envelope reversing direction into the guide rollers;

FIGS. 4 illustrating the envelope in the second parked position under the guide rollers with the envelope flap closed and positioned under the guide rollers;

FIGS. 5 illustrating the envelope in the third parked position under the primary seal roller;

DETAILED DESCRIPTION OF THE PRESENT INVENTION

In describing the present invention, reference is made to the drawings, wherein similar numeral references in FIGS. 1-7 designate similar elements in the various views. Where multiple elements such as rollers are illustrated in the perspective views of FIGS. 6 and 7, letters are used to designate these multiple elements.

The envelope closing system 2 is used to close and seal pre-moistened envelopes. Envelopes enter the envelope closing system 2 from the paper handing equipment such as a mailing machine or an inserter. The envelope closing system 2 may be part of the paper handling equipment or a separate module adapted to be connected to the paper handling equipment, as for example, a separate flats sealer module (FSM) for connection to an inserter system. The United States Postal Service designates mailpieces to be flats when the mail piece exceeds at least one of the dimensional regulations of letter-sized mail (e.g. over 11.5 inches long, over 6⅛ inches tall, or over ¼ inch thick) but does not exceed 15¾ inches by 12 inches by 1¼ inch thick. Flats include such mail as pamphlets, annual reports and the like.

Figure 1:
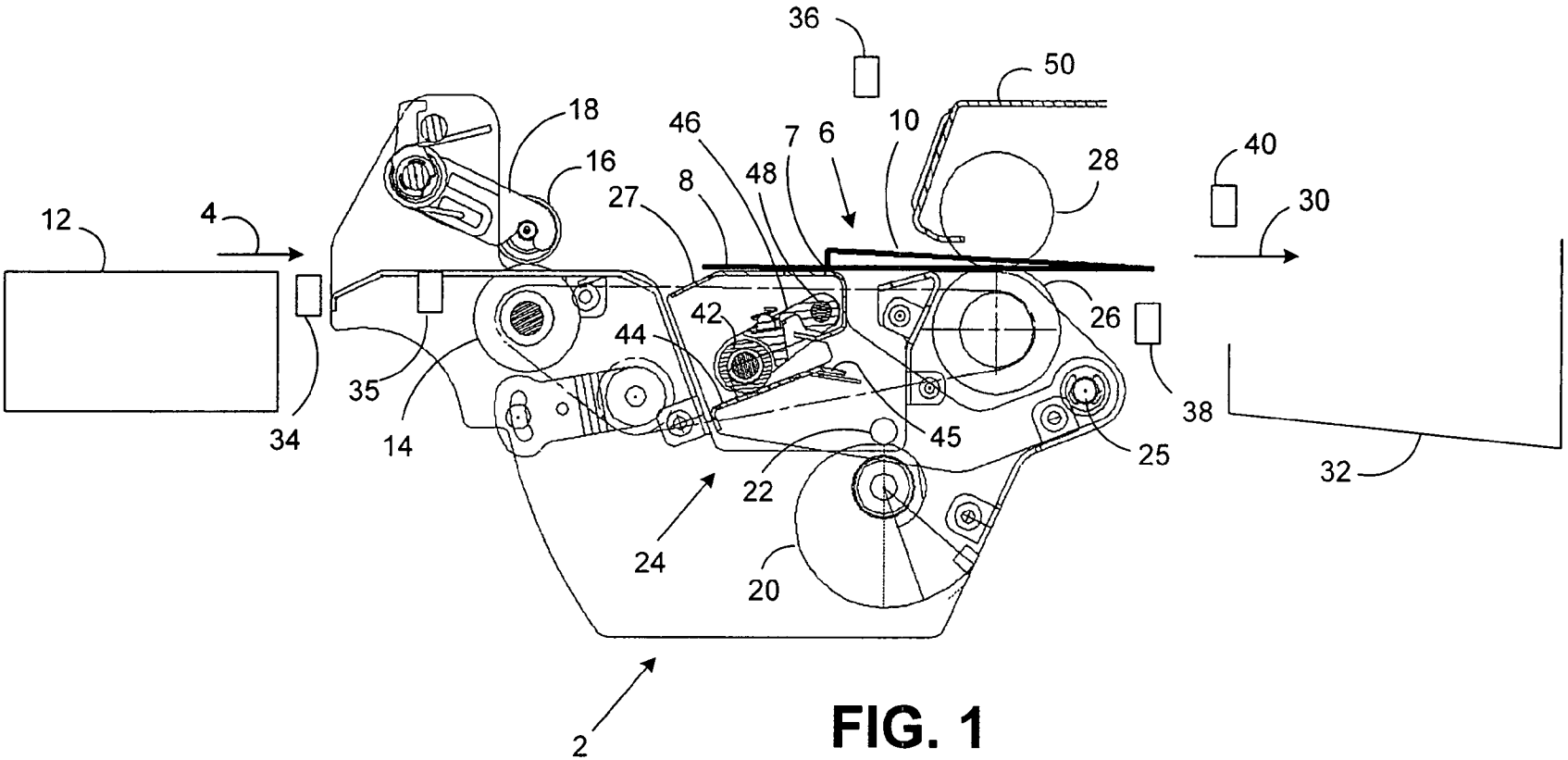

Envelopes enter the envelope closing system 2 in the direction of the arrow 4. The envelope, such as envelope 6, may have had the glue line on the envelope flap 8 moistened by a moistener 12. Any required stripping of the envelope flaps, that is, opening of the flap where required so that moisture can be applied to the flap glue line and the moistener 12 can be part of the paper handling equipment such as the system shown in U.S. patent application Ser. No. 11/084396, noted above. The envelope 6 enters the envelope closing system 2 with the flap 8 in the open position as is shown in FIG. 1. The envelope will be processed by the envelope closing system 2 as hereinafter described to be closed and sealed against the body 10 of the envelope 6.

As the envelope 6 is moved into the envelope closing system 2, it is moved into the system by a drive roller 14 operating in conjunction with an idler roller 16. The idler roller 16 is mounted to a spring loaded, pivotable arm 18.

As the envelope is moved into the envelope closing system, as is shown in FIG. 1, a cam 20 is positioned so that the cam follower 22 of the flap closing mechanism 24 positions the flap closing mechanism 24 below the path of travel of the envelope 6. The envelope 6 is also driven along the path of travel by the drive roller 26 in conjunction with a primary seal roller 28 in the direction of the exit arrow 30. Envelopes which exit the envelope closing system 2 may be stacked in a drop stacker 32 or other suitable stacking mechanism.

Various sensors are provided through the system to control the positioning of the envelope 6 within the envelope closing system 2 and the movement of the flap closing mechanism 24. These sensors include an envelope lead edge sensor 34 which may be part of the paper handling equipment or a lead edge sensor 35 which may be part of the flap closing mechanism 2, a second envelope lead edge sensor 36, an envelope park position sensor 38 and an envelope exit sensor 40. The position and operation of the particular sensing arrangement is not critical. The sensors provide information needed to control the movement of the envelope 6 through the envelope closing system 2 such that the envelope gets appropriately parked, that is stopped, at the required position for operation of the system including the movement of the flap closing mechanism 24.

Figure 2:
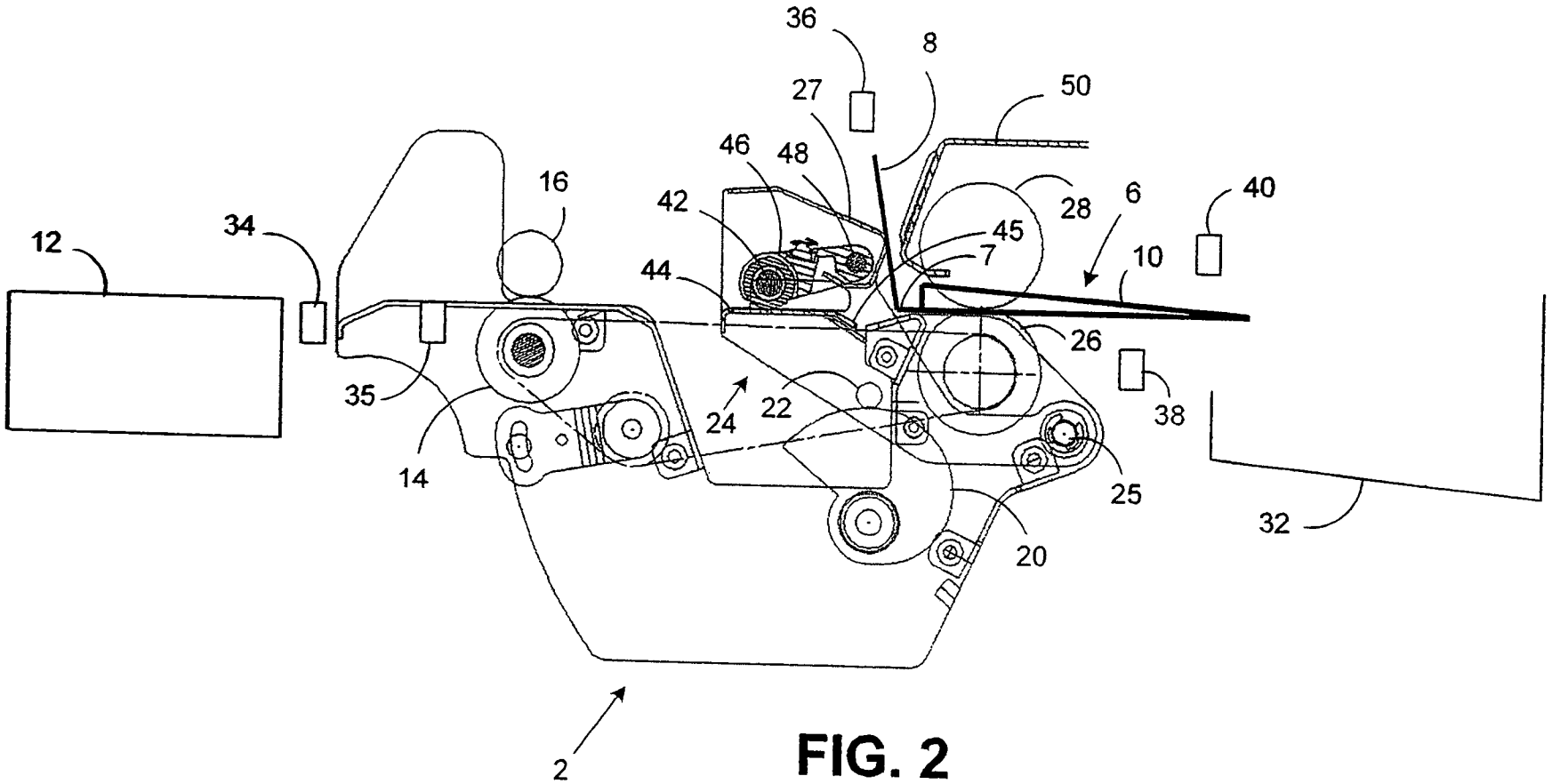

When the envelope 6 is in the first parked position, as shown in FIG. 2, the cam 20 is rotated such that the cam follower 22 moves the flap closing mechanism 24 toward the up position to begin closing the envelope flap 8. The sensors ensure that the envelope is properly parked. When properly parked in the first position, the envelope crease line 7 is positioned with respect to the envelope 6 path of travel to allow the flap closing mechanism 24 to begin the envelope flap closing by the rotation of the flap closing mechanism 24 around pivot 25. The flap closing mechanism rotates due to the action of cam 20 and cam follower 22. The envelope flap closing is effectuated by a surface 27 on the flap closing mechanism 24 urging the envelope flap 8 from a horizontal toward a vertical position.

Figure 3:
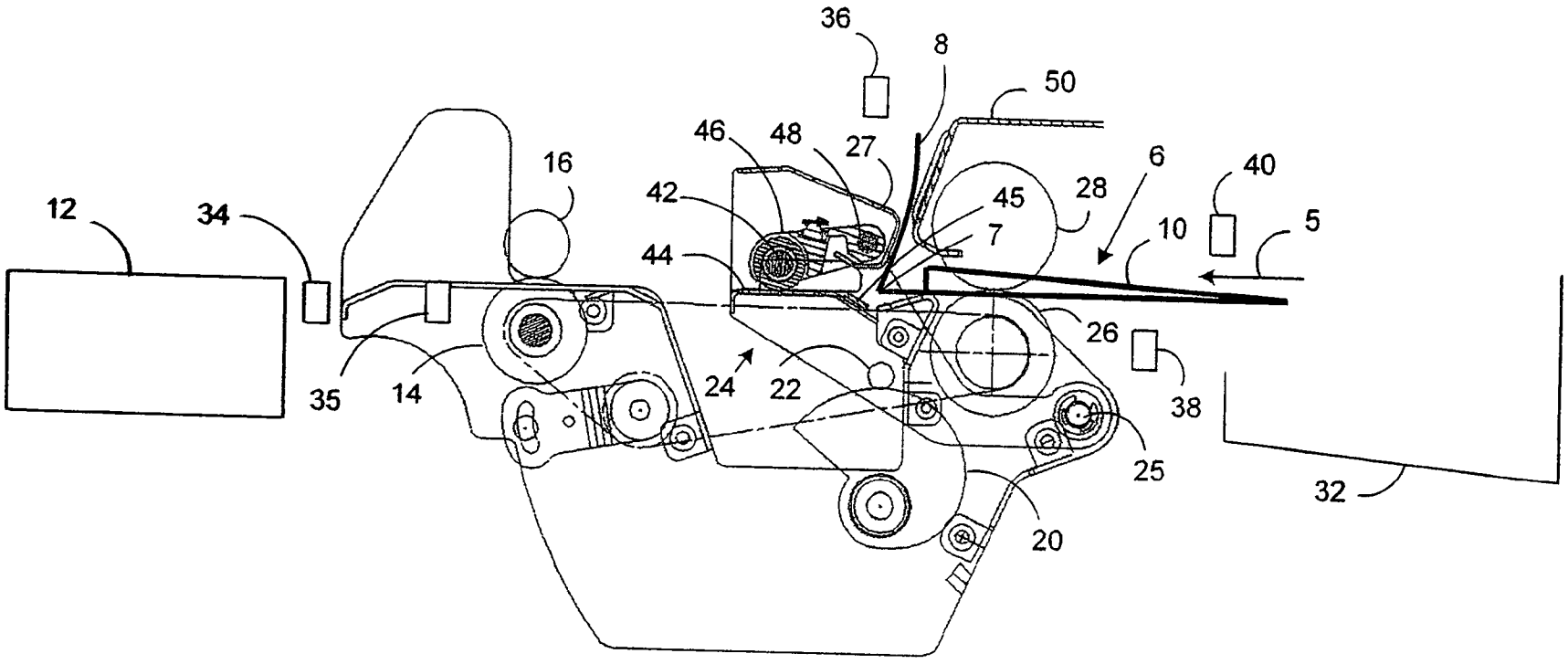

With the flap closing mechanism 24 in the up position, the envelope 6 is moved in a direction of arrow 5 opposite the process path as shown in FIG. 3. This is due to a reversal of the direction of rotation of the drive roller 26. This drives envelope 6 in the direction of arrow 5 toward the entrance to the envelope closing system 2. The envelope 6 is guided into the nip of roller 42 and surface 44. Roller 42 is mounted to a spring loaded pivotable arm 46. Arm 46 is pivoted on pivot 48 under the force of a spring, not shown. The flap 8 bears against raised portions 51*a*, 51*b*, 51*c* and 51*d*, shown most clearly in FIGS. 6 and 7, of a guide surface 50. Guide surface 50 prevents the moistened glue on the envelope flap from getting onto the primary seal roller 28. The raised portions 51*a*, 51*b*, 51*c* and 51*d* of guide surface 50 are located at positions where the glue line of the envelope flap is not moistened. Accordingly, the raised portions 51*a*, 51*b*, 51*c* and 51*d* are not subject to a build up of glue as envelopes move through the envelope closing system 2. This may be implemented by employing a segmented moistener brush as part of moistener 12.

Figure 4:
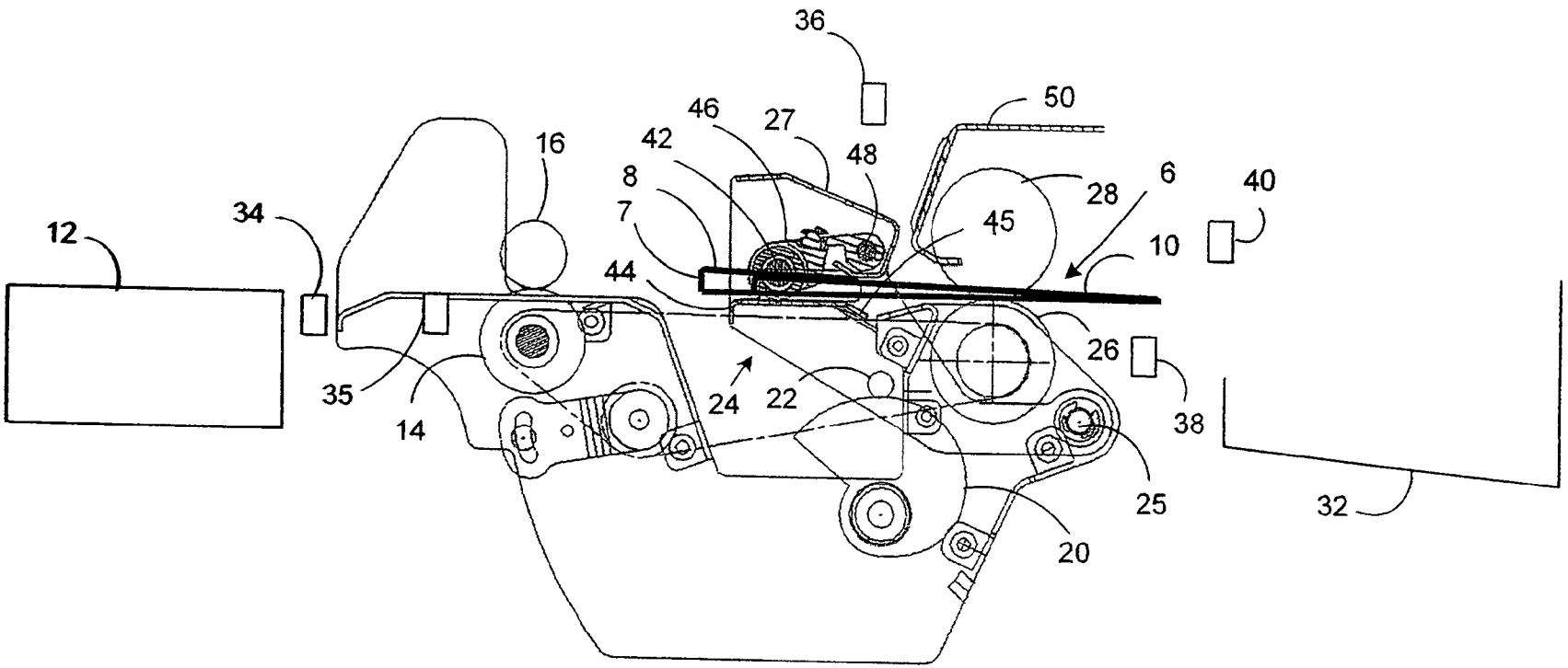

As is shown in FIG. 4, the envelope 6 is parked in the second park position with the envelope flap 8 closed and positioned under the guide roller 42. The envelope 6 may be parked in this position in the order of 15 milliseconds for sealing purposes in order to tack the moistened glue line of the envelope flap 8 to the body 10 of the envelope 6. The guide roller 42 commences the initial process of sealing the envelope due to the pressure of the roller 42 against the envelope flap 8.

With the envelope 6 parked in the guide rollers 44, the park time is used to begin the "tacking" process. This provides the added benefit of keeping the flap down before envelope 6 is transported to the larger primary seal roller 28. It is important that the envelope flap 8 stays closed for transport because premature opening of the envelope flap 8 may cause the flap to catch on adjacent guides. Proper guidance of the envelope 6 and the use of the small guiding rollers 44, as well as park time under the rollers 44 help ensure the flap stays down until the sealing of the envelope flap 8 to the envelope body 10 is complete.

Figure 5:
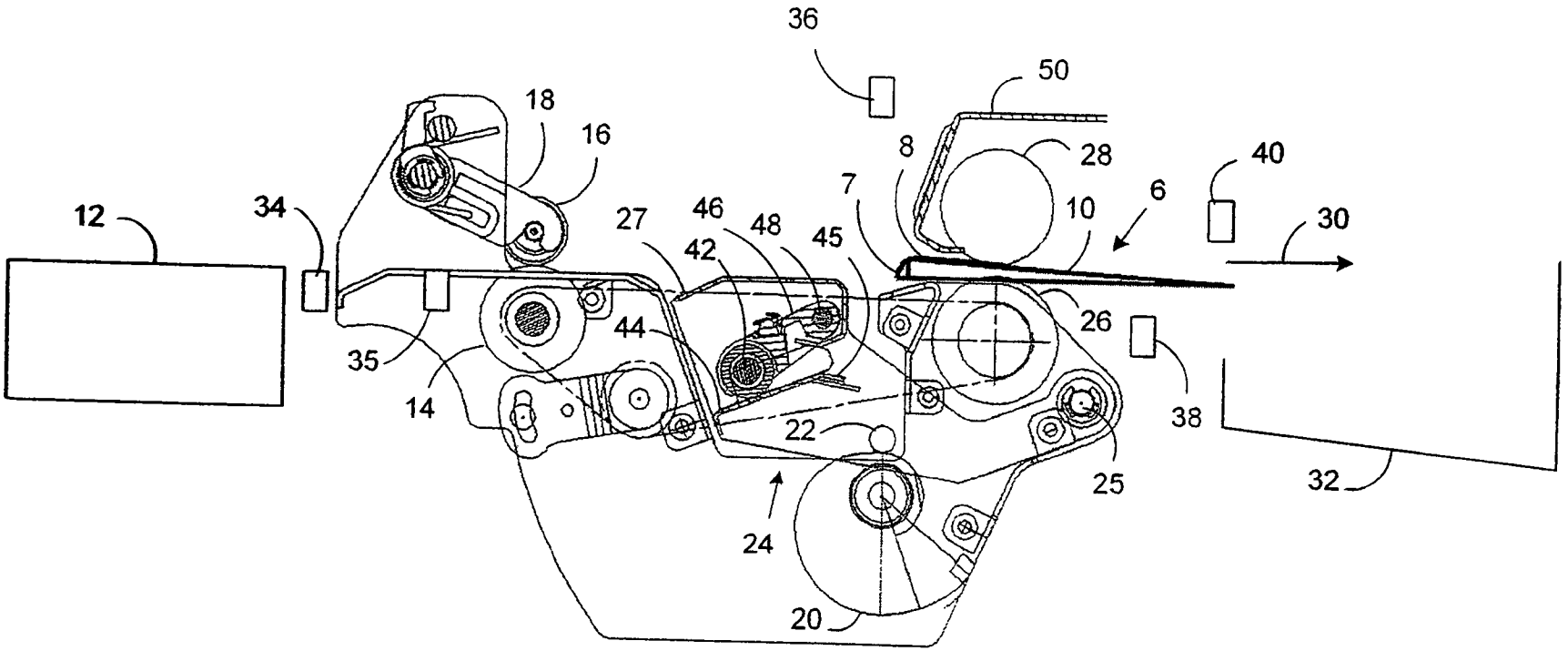
Figure 6:
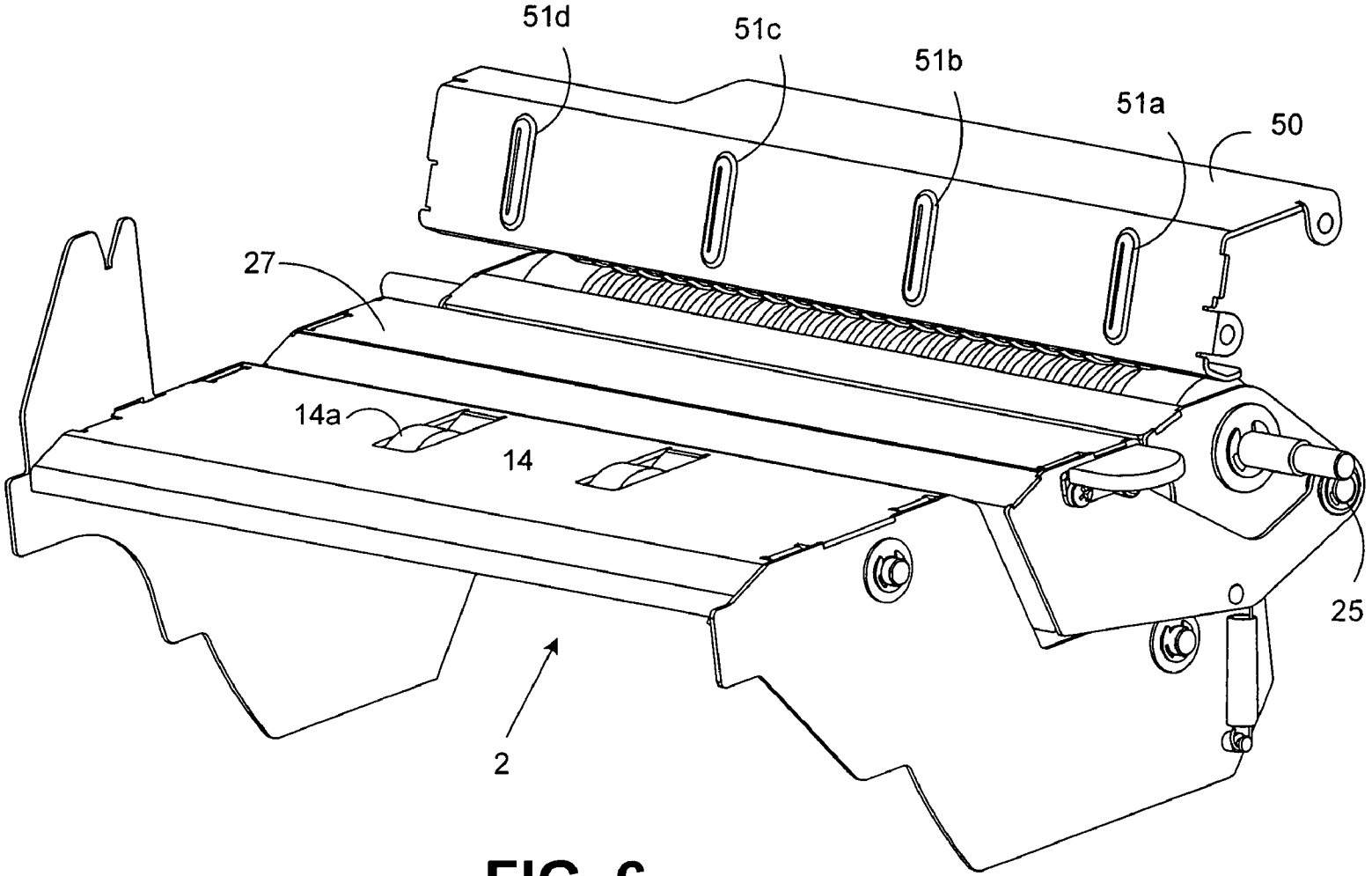
FIG. 6 is a perspective view, with certain components, removed of the of the envelopes closing system shown in FIGS. 1-5 with the envelope flap closing mechanism in the down position.
Figure 7:
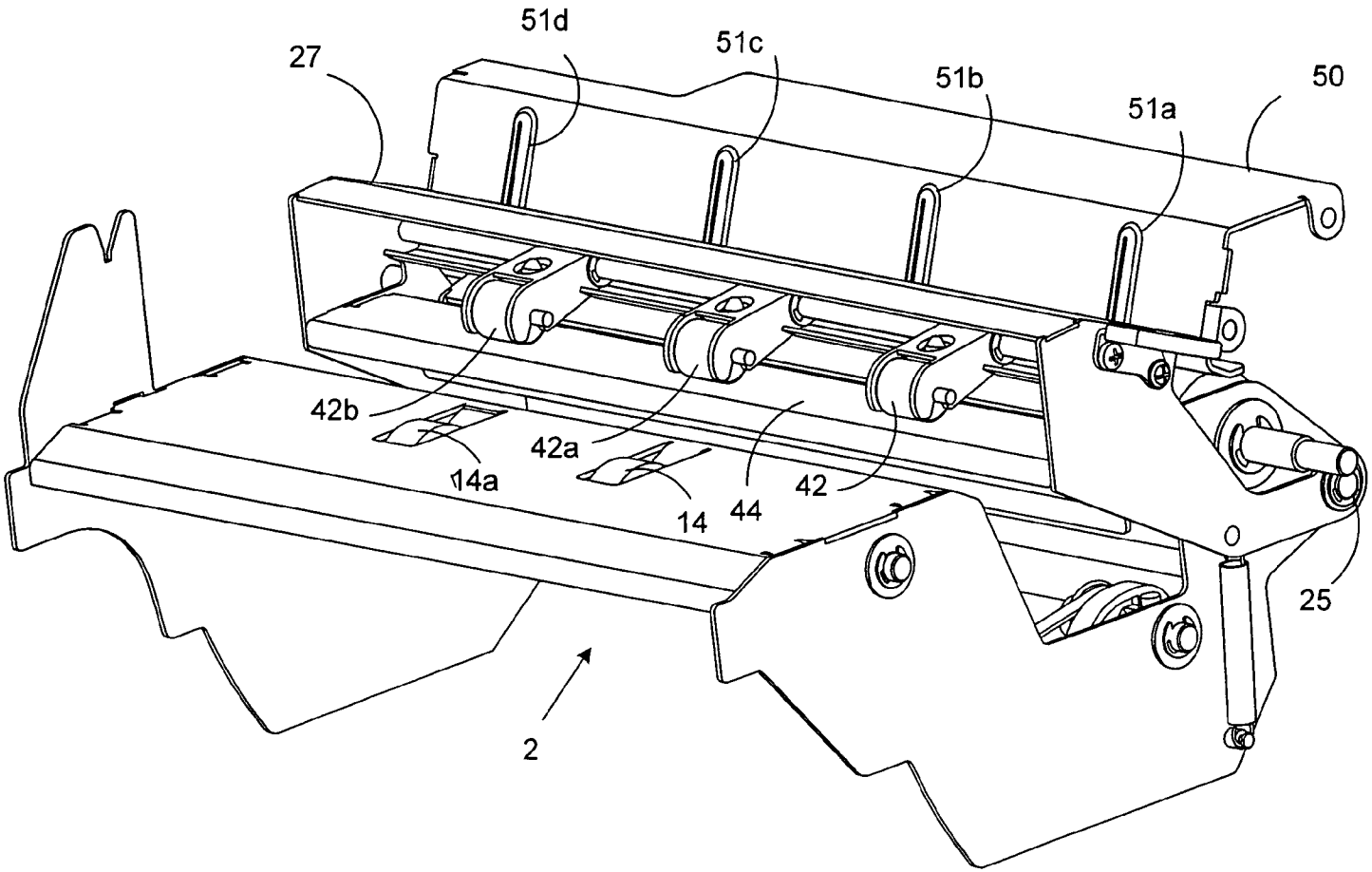
FIG. 7 is a perspective view, with certain components, removed of the of the envelopes closing system shown in FIGS. 1-5 with the envelope flap closing mechanism in the up position; and, FIG. 8 is a flow chart of the operation of the envelope closing system shown is FIGS. 1-7.

Envelope 6 is then moved as is shown in FIG. 5 in the direction of arrow 30 to be parked in a third parked position under the primary seal roller 28 for further sealing of the envelope flap 8 to the envelope body 10. The envelope 6 may be held in this third parked position for a defined period of time or, if longer than the defined period of time until the next envelope enters the envelope closing system 2. If the envelope is the last envelope in a series of envelopes to be processed, the time in the third parked position may be, for example, for approximately 100 milliseconds for high speed equipment or several seconds for slower speed equipment.

The park time of envelope 6 under the guide roller 42 and the primary seal roller 28 depends upon the nature of the envelope and the nature of the glue employed for sealing flap 8. Further sealing may occur after the envelope has exited the envelope closing system 2 and is stacked, for example, in stacking bin 32. As can be seen in FIG. 5, when the envelope 6 is parked under the primary seal roller 28, the flap closing mechanism 24 is moved to the initial position below the primary path of travel. The envelope closing system 2 is then in condition for the next envelope to be moved into the system.

The envelope 6 and other envelopes being moved seriatim through the envelope closing system 2 travel along a processing path of travel in the direction of arrow 4 and arrow 30. During the transit of each envelope through the system 2 in the direction of arrow 4 and arrow 30, the flap closing mechanism is moved below the path of travel of the envelope. During transit of each envelope through the system 2 in the direction of arrow 5, the flap closing mechanism 24 is moved to the up position and provides an alternative path of travel for the envelope when being moved in the reverse direction. As is shown in FIG. 3, the alternative path of travel includes the path along the guide surface 44 and guide roller 42. The guide surface 44 has a sloped portion 45 to prevent the edge of the envelope 6 snagging as it reverses direction and is guided into the nip between roller 42 and guide surface 44.

It should be noted that during transit of an envelope through the envelope closing system 2, the body of the envelope does not need to be flexed and can travel a straight line path. Only the envelope flap is flexed as is shown in FIG. 3. Moreover, the amount of flexure of the envelope flap can be controlled by selecting the dimensions and spacing of the various components of the envelope closing system 2 such as guide surfaces 27 and 50 and the lateral spacing between guide surfaces 27 and 50.

In operation, the envelope 6 is parked in the first park position and then a flap closing mechanism 24 is moved to the upper position to initiate envelope flap closing. The direction of travel of the envelope 6 is then reversed. As the envelope 6 reverses direction of travel, the flap is further closed. After being parked in the second park position, the envelope 6 direction of travel is again reversed to the forward process direction of arrows 4 and 30. The envelope 6 is then parked in a third park position under the larger primary seal roller 28. As the envelope moves forward, the flap closing mechanism 24 is lowered to accept another envelope to be moved seriatim into the envelope closing system 2. The envelope 6 stays parked in the third park position under the primary seal roller as long as the cycle time permits. This ensures maximum time for the applied sealing pressure.

The flap closing mechanism 24 provides of a dual sided envelope transport path and includes the with smaller guide rollers 42 carried within it. When the envelope 6 enters the envelope closing system 2 the envelope 6 is driven over the flap closing mechanism 24 in its lowered position. Therefore the top portion of the flap closing mechanism 24 provides an envelope transport guided path surface. After the envelope is moved into the proper park position, the flap closing mechanism 24 is raised upward. Once fully raised, the lower envelope transport guide surface and rollers are operative. As the envelope reverses into the flap closing mechanism 24, the upper and lower surfaces 27 and 45 guide the envelope flap into the small guiding rollers until the envelope is parked with the envelope flap 8 glue line directly under the guide rollers 44.

In order to park different envelops with different envelope body and envelope flap lengths in the various parked positions including directly under the guide rollers 44, information from the paper handling equipment along with data collected in the envelope closing system 2 can be employed to calculate the flap length. Once the flap length is known, the envelope closing system 2 can park the envelope and envelope flap in the correct park positions.

Figure 8:
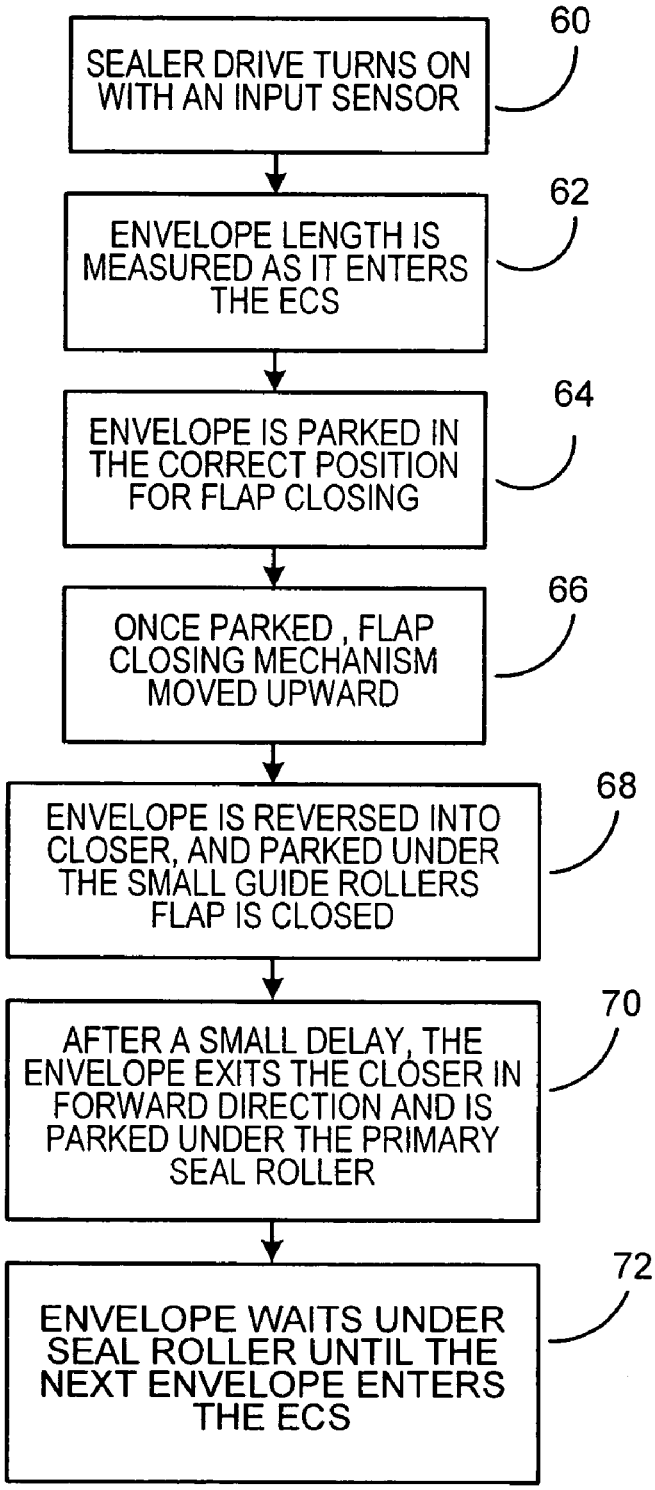

Reference is now made to FIG. 8 which shows the flow chart of the operation of the envelope closing system 2. At 60 the sealer drive roller 14 is turned on with either a sensor 34, which may be in the paper handling equipment or an input sensor 35 which may be part of the flap closing mechanism 2. The envelope length is measured as it enters the envelope closing system 2 at 62. The envelope is then parked in the correct position for flap closing at 64. This parking can be initiated by sensor 36 to detect the lead edge of the sensor and information as to the envelope length measurement, which may be computed based on sensor data or entered into the system. Once the envelope 6 is parked, the flap closing mechanism 24 is moved upward at 66. This may be by means of the cam 20 and the cam follower 45 or by other suitable arrangements such as stepper motors, solenoids and the like.

At 68, the envelope is reversed into the flap closing mechanism 24 and is parked under the small guide rollers 42. At this time, the envelope flap 8 is closed having been fully moved to lie against the body 10 of envelope 6. The envelope 6 may be parked in this position for a period of time as noted above to commence any sealing of the envelope flap 8 to the envelope body 10. The envelope 6 with the flap closed and, where applicable with sealing having been commenced, is moved toward the envelope closing system exit in the direction of arrow 4 and arrow 30. Envelope 6 is then parked under the primary seal roller 28 at 70. The envelope 6 remains parked under the primary seal roller 28 until the next envelope enters the envelope closing system at 72.

While the present invention has been described in connection with what is presently considered to be the most practical and preferred embodiments, it is to be understood that the invention is not limited to the disclosed embodiment, but, on the contrary, is intended to cover various modifications and equivalent arrangements included within the spirit and scope of the intended claims. For example, various types of transport belts and transport systems can be employed. Moreover, the configuration and placement of the components such as the cams, cam followers, rollers, guides and the like can be modified. The adjustment of the flap assembly can be by servomotors, solenoids and other movement control systems. Additionally, the flap closing mechanism can be used where an envelope flap is closed but not sealed.

What is claimed is:

1. An envelope flap closing system, comprising:

a first transport path of travel for envelopes to be moved seriatim in a first direction from an entrance point to an exit point;

a moveable flap closing mechanism mounted along said path of travel for movement between a lower position and an upper position, said flap closing mechanism having an upper guide surface and a lower guide surface; said flap closing mechanism upper guide surface providing a guide surface as part of said first path of travel for envelopes being transported in said first direction when said flap closing mechanism is in said lower position; and, said flap closing mechanism lower guide surface providing a guide surface as part of a second path of travel for envelopes being transported in a second direction when said flap closing mechanism is in said upper position, wherein said first transport path includes a first parking position for envelopes where said flap closing mechanism is operable to engage a parked envelope flap that is stopped at a required position for operation of said system including movement of said flap closing mechanism when said flap closing mechanism is moved from said lower position to said upper position and said second transport path includes a second parking position for envelopes where the flap of a parked envelope is engaged by rollers mounted to and moveable with said flap closing mechanism; and a primary seal roller mounted along said first transport path down stream of said first parking position and wherein said first transport path further includes a third parking position for envelopes where the flap of a parked envelope is engaged by said primary seal roller.

2. An envelope flap closing system as defined in claim 1 wherein said rollers being operative and part of said second path of travel when said flap closing mechanism is in said upper position.

3. An envelope flap closing system as defined in claim 1 further including a guide surface positioned above said primary seal roller and having raised portions on said guide surface for guiding an envelope flap when said envelope is moved in said second direction.

* * * * *